US012352025B1

(12) United States Patent
Zhong et al.

(10) Patent No.: US 12,352,025 B1
(45) Date of Patent: Jul. 8, 2025

(54) FAUCET DEVICE FOR REGULATING HOT AND COLD WATER

(71) Applicants: Hua Zhong, Ganzhou (CN); Yihe Chen, Ruian (CN)

(72) Inventors: Hua Zhong, Ganzhou (CN); Yihe Chen, Ruian (CN)

( * ) Notice: Subject to any disclaimer, the term of this patent is extended or adjusted under 35 U.S.C. 154(b) by 0 days.

(21) Appl. No.: 19/018,350

(22) Filed: Jan. 13, 2025

(30) Foreign Application Priority Data

Dec. 20, 2024 (CN) ..... 202423160457.7

(51) Int. Cl.
*E03C 1/04* (2006.01)

(52) U.S. Cl.
CPC ..... *E03C 1/0412* (2013.01); *Y10T 137/9464* (2015.04)

(58) Field of Classification Search
CPC . E03C 1/0404; E03C 1/0412; Y10T 137/9464
USPC ..... 137/801
See application file for complete search history.

(56) References Cited

U.S. PATENT DOCUMENTS 5,873,389 A * 2/1999 Cheng ..... F16K 5/061 251/315.12
2020/0332502 A1* 10/2020 Rowe ..... E03C 1/0404

* cited by examiner

*Primary Examiner* — Daphne M Barry
(74) *Attorney, Agent, or Firm* — Birchwood IP

(57) ABSTRACT

A faucet device for regulating hot and cold water is provided, which includes a water outlet main body and two sets of regulation components. The water outlet main body is provided with a water outlet, a cold water outlet, and a hot water outlet. The cold water outlet is communicated to the water outlet, and the hot water outlet is communicated to the water outlet. The two sets of regulation components are provided on the water outlet main body and configured to regulate water inflow. A water outlet end of one regulation component is communicated to the cold water outlet and a water inlet end of the regulation component is communicated to a cold water pipe; a water outlet end of the other regulation component is communicated to the hot water outlet and a water inlet end of the other regulation component is communicated to a hot water pipe.

9 Claims, 9 Drawing Sheets

A

B

FAUCET DEVICE FOR REGULATING HOT AND COLD WATER

CROSS-REFERENCE TO RELATED APPLICATIONS

This application claims priority to Chinese Patent Application No. 202423160457.7, filed on Dec. 20, 2024, which is hereby incorporated by reference in its entirety.

TECHNICAL FIELD

The present disclosure relates to the field of faucet technologies, and in particular, to a faucet device for regulating hot and cold water.

BACKGROUND

Faucet is a common term for water valve, used to control the water flow and has the effect of saving water; as is well known, our lives cannot do without water, which means that people need various types of faucets and valves. The faucets have been replaced, from old-fashioned cast iron technology to electroplated knob type, and then to stainless steel single temperature single control faucets, stainless steel dual temperature dual control faucets, and kitchen semi-automatic faucets. Nowadays, more and more consumers are considering various aspects such as material, function, and shape when choosing a faucet. In which, the hot and cold faucets cleverly achieve the ratio of hot and cold water through the internal valve core.

In general, the valve core of the existing hot and cold faucets consists of three holes. One hole is used for cold water inlet and outlet, the other for hot water inlet and outlet, and the remaining hole is used for faucet water outlet. By driving the valve core to rotate through a switch of the faucet, the temperature of the faucet water outlet can be adjusted by changing the ratio of cold water and hot water inlet while maintaining the same water flow rate.

With regarding to the relevant technologies mentioned above, when adjusting the water outlet temperature of the faucet, while increasing the amount of cold water entering and reducing the amount of hot water entering, which leads to the difficulty of adjusting the water outlet temperature of the faucet to the most suitable temperature when the valve core is rotated at the same unit angle.

SUMMARY

In order to render it easier for a user to adjust the water outlet temperature of a faucet to a suitable use temperature, the present application provides a faucet device for regulating hot and cold water.

The faucet device for regulating hot and cold water provided in the present application adopts the following technical solution as follows.

The faucet device for regulating hot and cold water, which includes a water outlet main body and two sets of regulation components; the water outlet main body is provided with a water outlet, a cold water outlet, and a hot water outlet; the cold water outlet is communicated to the water outlet, and the hot water outlet is communicated to the water outlet; the two sets of regulation components are both provided on the water outlet main body and configured to regulate water inflow; a water outlet end of one regulation component is communicated to the cold water outlet, and a water inlet end of the regulation component is communicated to a cold water pipe; a water outlet end of the other regulation component is communicated to the hot water outlet, and a water inlet end of the other regulation component is communicated to a hot water pipe.

By adopting the above technical solution, when the water outlet temperature of the faucet needs to be adjusted, water inlet volumes of the two sets of adjustment components are adjusted separately, thereby changing the water inlet volume of the cold water outlet and the water inlet volume of the hot water outlet. As the water inlet volumes of the cold water outlet and the hot water outlet are changed, the water inlet ratio between the cold water and hot water are changed, resulting in a change in the water outlet temperature of the water outlet. When the water outlet temperature is too high or too low, the water inlet volumes of the cold water or hot water are adjusted separately by the two adjustment components, thereby achieving the adjustment of the water outlet temperature by separately changing the water inlet volume of the cold water or hot water. This renders it easier for a user to adjust the water outlet temperature of the faucet to a suitable use temperature, improves a problem of increasing the amount of cold water entering and reducing the amount of hot water entering when adjusting the water outlet temperature of the faucet, which results in a difficult change in the ratio of cold water and hot water entering when the valve core is rotated at the same unit angle and results in a difficult for the user to adjust the water outlet temperature of the faucet to the suitable use temperature.

In some embodiments of the present application, the water outlet main body is provided with a water outlet channel, the water outlet channel is communicated to the water outlet, and the water outlet channel is curved in an arc shape.

In some embodiments of the present application, the water outlet channel is fixedly provided with a filter screen.

In some embodiments of the present application, the water outlet main body includes a main body and a water outlet part, the main body and the water outlet part are fixedly connected; the main body is provided with two first inlet channels and two second inlet channels; one end of one first inlet channel is communicated to the cold water pipe and the other end of the first inlet channel is communicated to the water inlet end of one regulation component; one end of the other first inlet channel is communicated to the hot water pipe and the other end of the other first inlet channel is communicated to the water inlet end of the other regulation component; one end of one second inlet channel is communicated to the water outlet end of one regulation component and the other end of the second inlet channel is communicated to the cold water outlet; one end of the other second inlet channel is communicated to the water outlet end of the other regulation component and the other end of the other second inlet channel is communicated to the hot water outlet.

In some embodiments of the present application, the regulation components include an adjustment seat, an adjustment valve core, an adjustment valve body, and an adjustment handle; the adjustment seat is fixedly provided on the water outlet main body, the adjustment valve core is rotatably provided on the adjustment seat, the adjustment valve core is fixedly provided with an adjustment block, the adjustment valve body is fixedly provided on the adjustment seat; the adjustment valve body is provided with an adjustment port that is penetrated, and adjustment port is communicated to the cold water pipe; the adjustment handle is rotatably provided on the adjustment seat and is fixedly connected to the adjustment valve core; when the adjustment valve core is rotated, the adjustment port is closed.

In some embodiments of the present application, the adjustment seat includes a seat body part and a valve body part; the seat body part and the valve body part are fixedly connected; and a water outlet chamber is formed between the seat body part and the valve body part, the water outlet chamber is communicated to the cold water outlet, the adjustment valve body is fixedly provided on the valve body part, and the valve body part is provided with a water outlet groove that is penetrated; the water outlet groove is communicated to the water outlet chamber; when the adjustment port is opened, the adjustment port is communicated to the water outlet groove;

where the regulation components further include a first sealing ring that is fixedly provided on the valve body part, one end of the first sealing ring abuts against the adjustment valve body, and the other end of the first sealing ring abuts against the water outlet main body.

By adopting the above technical solution, the providing of the first sealing ring renders it difficult for water to penetrate into the water outlet chamber from a contact position between the valve body part and the water outlet main body when it enters the valve body part, thereby improving an adjustment effect of the regulation components on the water inlet volume and enhancing its usability.

In some embodiments of the present application, the regulation components further include a second sealing ring; the second sealing ring is fixedly provided on an outer peripheral surface of the valve body part and abuts against the seat body part.

By adopting the above technical solution, the providing of the second sealing ring renders it difficult for water to seep out of the regulation components from a connection position between the seat body part and the valve body part when enters and exits the water outlet chamber, thereby improving the sealing performance of the regulation components against water and enhancing its usability.

In some embodiments of the present application, the regulation components further include a plurality of third sealing rings, each of which is fixedly provided on the adjustment valve core and abuts against the valve body part.

By adopting the above technical solution, the providing of the third sealing ring renders it difficult for water to seep out of the regulation components from a connection position between the adjustment valve core and the valve body part when it enters and exits the water outlet chamber, thereby improving the sealing performance of the regulation components against water and enhancing its usability.

In some embodiments of the present application, the regulation components further include a fixing nut, the fixing nut is threaded to an outer peripheral surface of the adjustment seat and abuts against the water outlet main body.

In some embodiments of the present application, two waterproof rings are fixedly provided at a bottom of the water outlet main body, one is located between the cold water pipe and the main body, and the other is located between the hot water pipe and the main body.

In summary, the present application includes at least one beneficial technical effect as follows.

When the water outlet temperature of the faucet needs to be adjusted, water inlet volumes of the two sets of adjustment components are adjusted separately, thereby changing the water inlet volume of the cold water outlet and the water inlet volume of the hot water outlet. As the water inlet volumes of the cold water outlet and the hot water outlet are changed, the water inlet ratio between the cold water and hot water are changed, resulting in a change in the water outlet temperature of the water outlet. When the water outlet temperature is too high or too low, the water inlet volumes of the cold water or hot water are adjusted separately by the two adjustment components, thereby achieving the adjustment of the water outlet temperature by separately changing the water inlet volume of the cold water or hot water. This renders it easier for a user to adjust the water outlet temperature of the faucet to a suitable use temperature, improves a problem of increasing the amount of cold water entering and reducing the amount of hot water entering when adjusting the water outlet temperature of the faucet, which results in a difficult change in the ratio of cold water and hot water entering when the valve core is rotated at the same unit angle and results in a difficult for the user to adjust the water outlet temperature of the faucet to the suitable use temperature.

Numeral reference: 1—water outlet main body; 11—water outlet; 12—cold water outlet; 13—hot water outlet; 14—main body; 141—first inlet channel; 142—second inlet channel; 15—water outlet part; 151—water outlet channel; 152—filter screen; 2—regulation component; 21—adjustment seat; 211—seat body part; 212—valve body part; 2121—water outlet groove; 213—water outlet chamber; 22—adjustment valve core; 221—rotating part; 2211—rotation bump; 222—sealing part; 2221—rotation recess; 2222—sealing protrusion; 223—valve core part; 2231—sealing recess; 2232—adjustment block; 23—adjustment valve body; 231—adjustment port; 24—adjustment handle; 25—first sealing ring; 26—second sealing ring; 27—third sealing ring; 28—fixing nut; 29—waterproof ring.

DESCRIPTION OF EMBODIMENTS

Further, a detailed explanation of the present application will be provided in combination with FIGS. 1-9.

Figure 1:
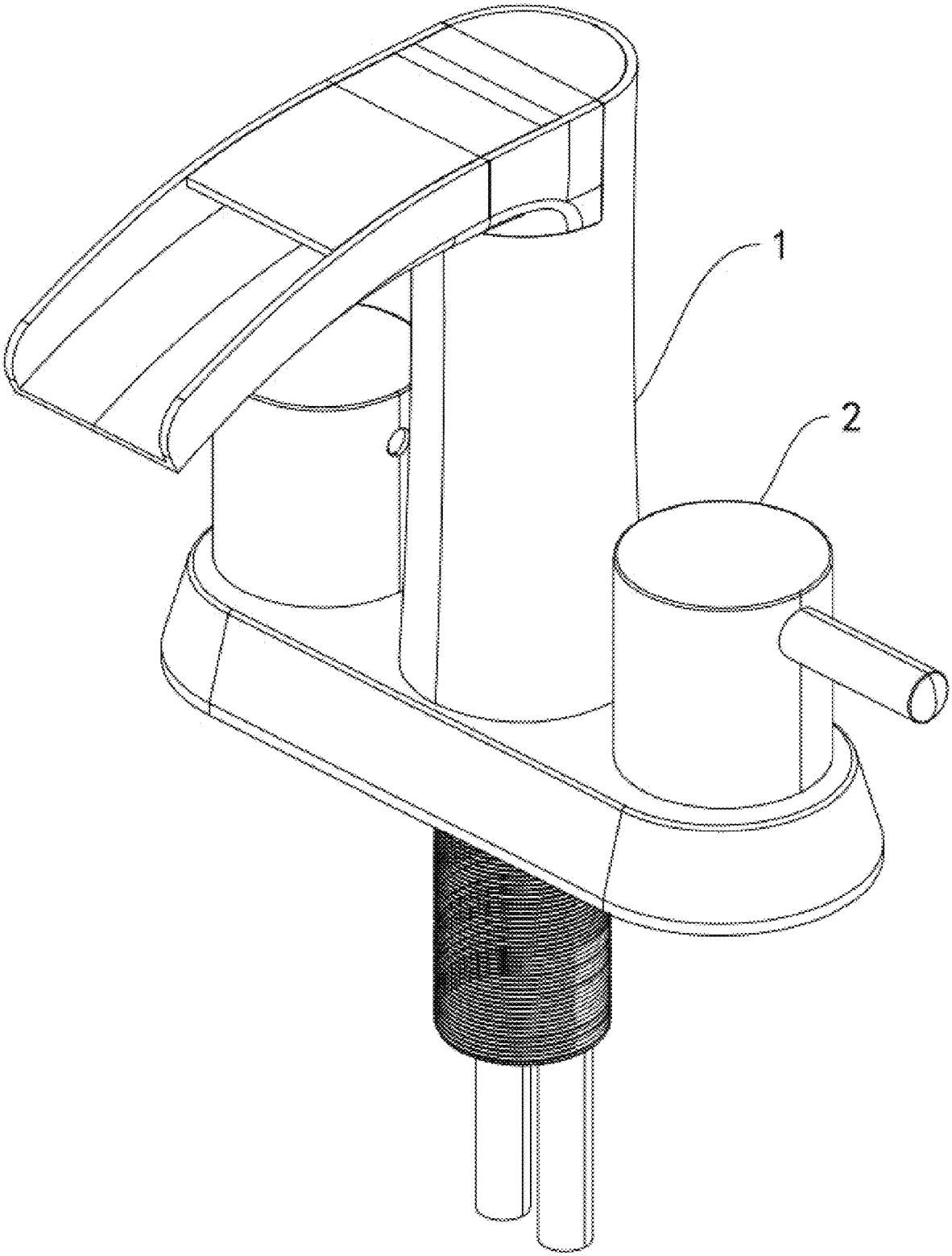
FIG. 1 is a schematic diagram of an overall structure of an embodiment of the present application.

The present embodiment discloses a faucet device for regulating hot and cold water. Referring to FIG. 1, the faucet device for regulating hot and cold water includes a water outlet main body 1 and two sets of regulation components 2. The two sets of regulation components 2 are both provided on the water outlet main body 1 and distributed symmetrically along a center surface of the water outlet main body 1.

Figure 2:
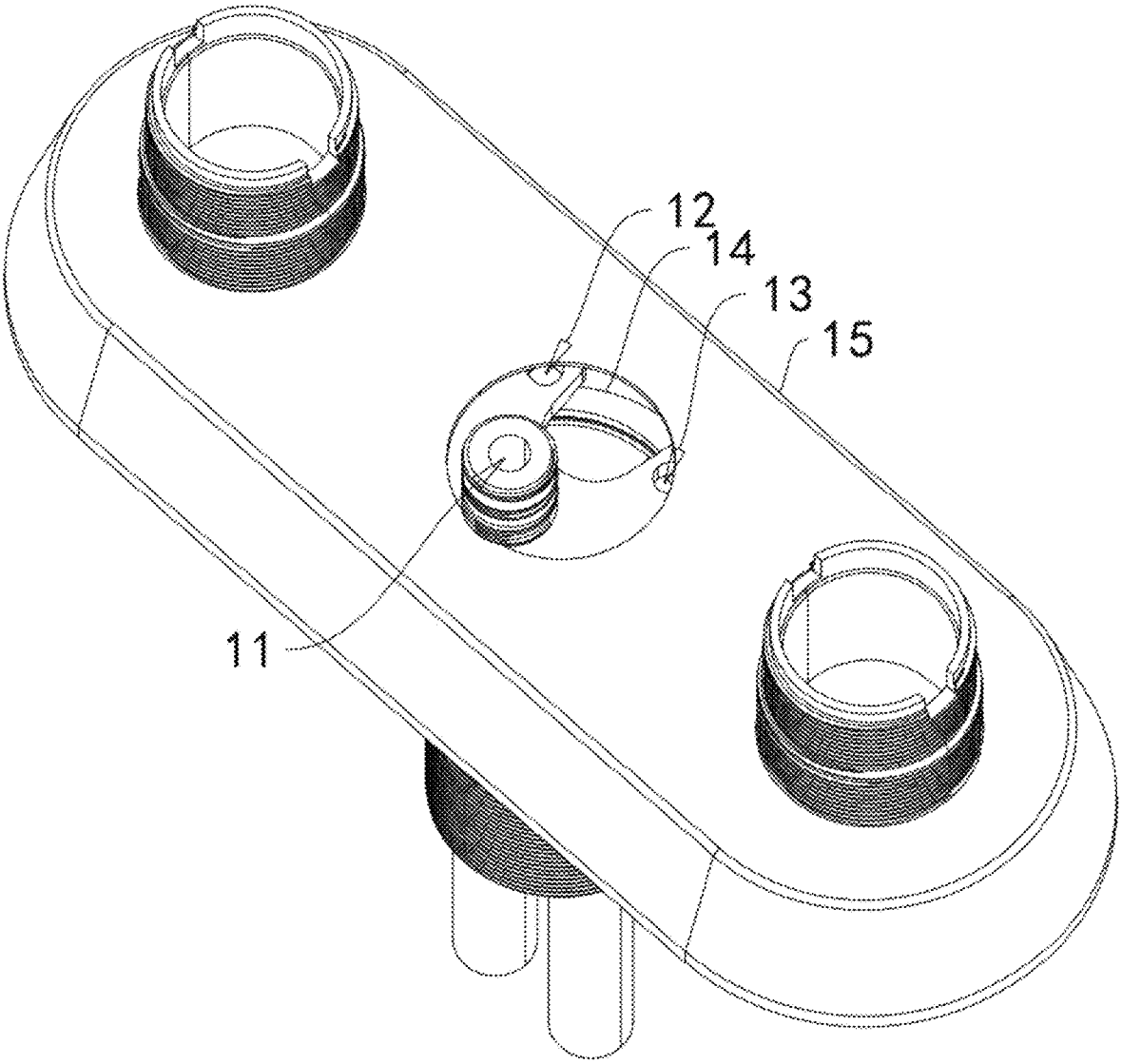
FIG. 2 is a schematic structural diagram of a water outlet main body in an embodiment of the present application.

Referring to FIG. 2, the water outlet main body 1 is provided with a water outlet 11, a cold water outlet 12, and a hot water outlet 13. The cold water outlet 12 is communicated to the water outlet 11, and the hot water outlet 13 is communicated to the water outlet 11. The water outlet main body 1 includes a main body 14 and a water outlet part 15. The main body 14 has a waist shaped cross-section, and the water outlet part 15 is fixedly connected to a middle position on one side of the main body 14.

Figure 3:
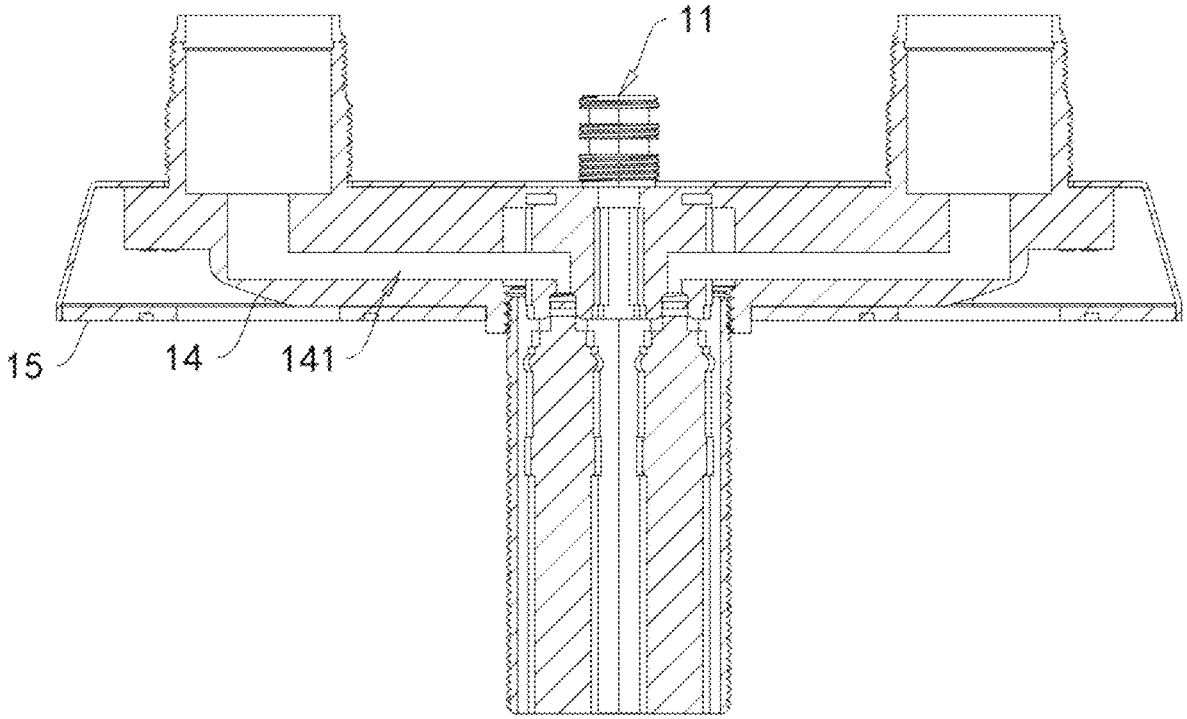
FIG. 3 is a schematic structural diagram of a first inlet channel in an embodiment of the present application.
Figure 4:
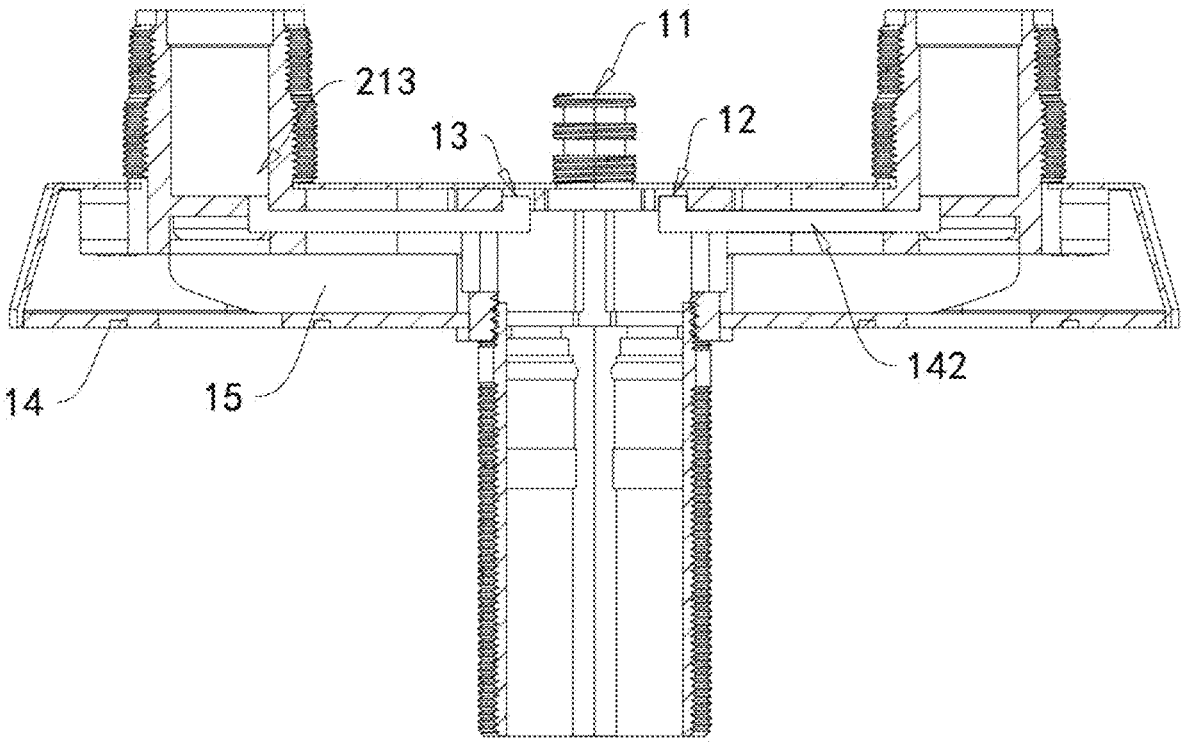
FIG. 4 is a schematic structural diagram of a second inlet channel in an embodiment of the present application.

Referring to FIGS. 3 and 4, the main body 14 is provided with two first inlet channels 141 and two second inlet channels 142. The two first inlet channels 141 and the two second inlet channels 142 are provided in parallel. The two first inlet channels 141 are symmetrically distributed along a middle of the water outlet part 15, and the two second inlet channels 142 are symmetrically distributed along the middle surface of the water outlet part 15. One end of one first inlet channel 141 close to the middle of the water outlet part 15 is communicated to a cold water pipe, the other end of the first inlet channel 141 near the middle of the water outlet part 15 is communicated to a hot water pipe; one end of one second inlet channel 142 near the middle of the water outlet part 15 is communicated to the cold water outlet 12, and the other end of the second inlet channel 142 near the middle of the water outlet part 15 is communicated to the hot water outlet 13.

As a result, the installation mode of the faucet has changed from a two-foot installation mode to a single-foot installation mode, rendering the installation of the faucet simpler and more convenient.

Figure 5:
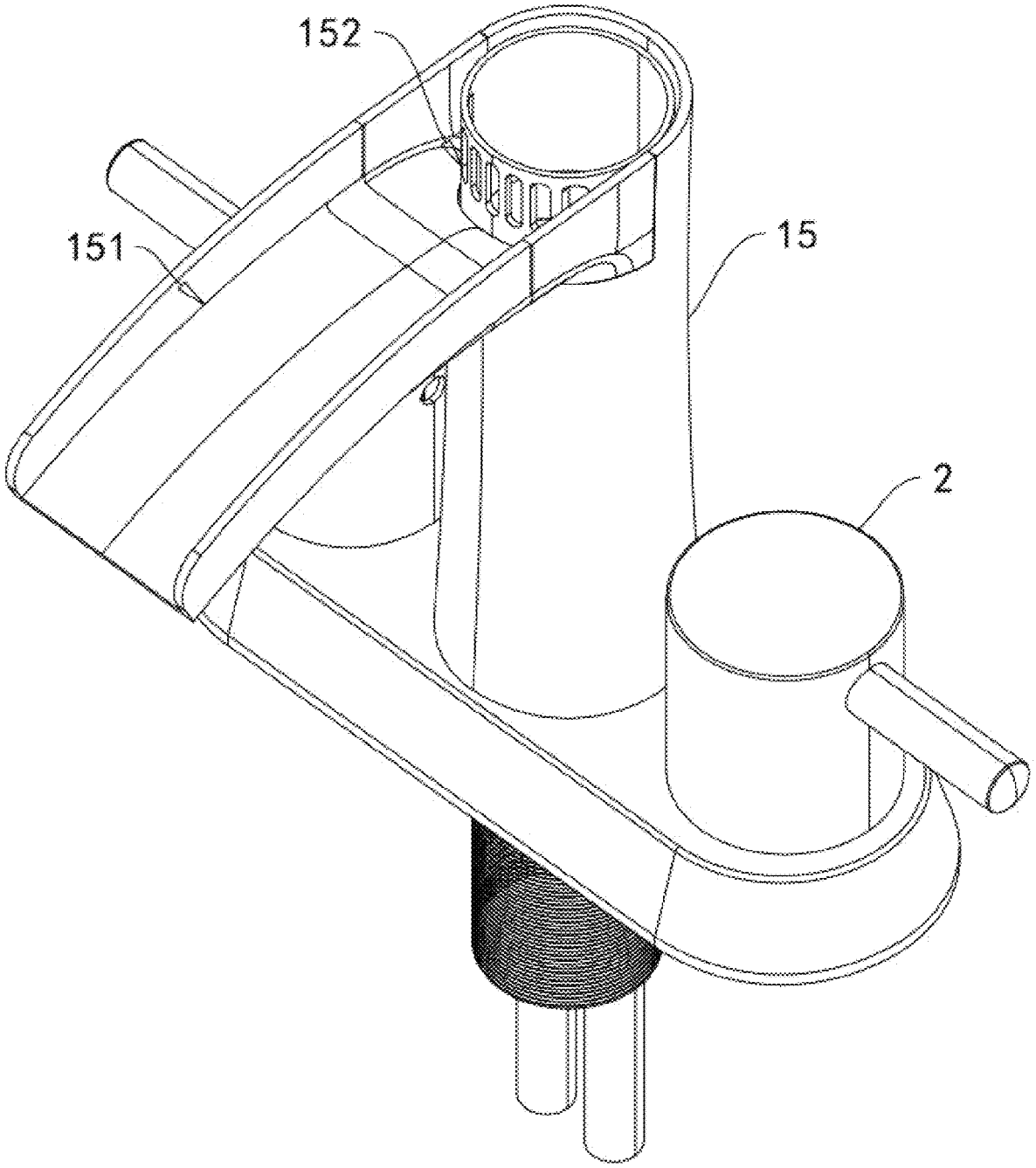
FIG. 5 is a schematic structural diagram of a water outlet part in an embodiment of the present application.

Referring to FIG. 5, a water outlet channel 151 is provided at a top of the water outlet part 15, the water outlet channel 151 is communicated to the water outlet 11. The water outlet channel 151 is curved in an arc shape, so that when the faucet is running water, the water can freely fall along the water outlet channel 151, reducing the content of bubbles in the water and rendering the water outlet of the faucet smoother, thereby providing a better user experience.

Referring to FIG. 5, the water outlet channel 151 is fixedly provided with a filter screen 152, which breaks the bubbles contained in the water flowing into the water outlet channel 151, thereby further reducing the content of bubbles in the water flowing into the water outlet channel 151 and improving the user experience of the faucet.

Figure 6:
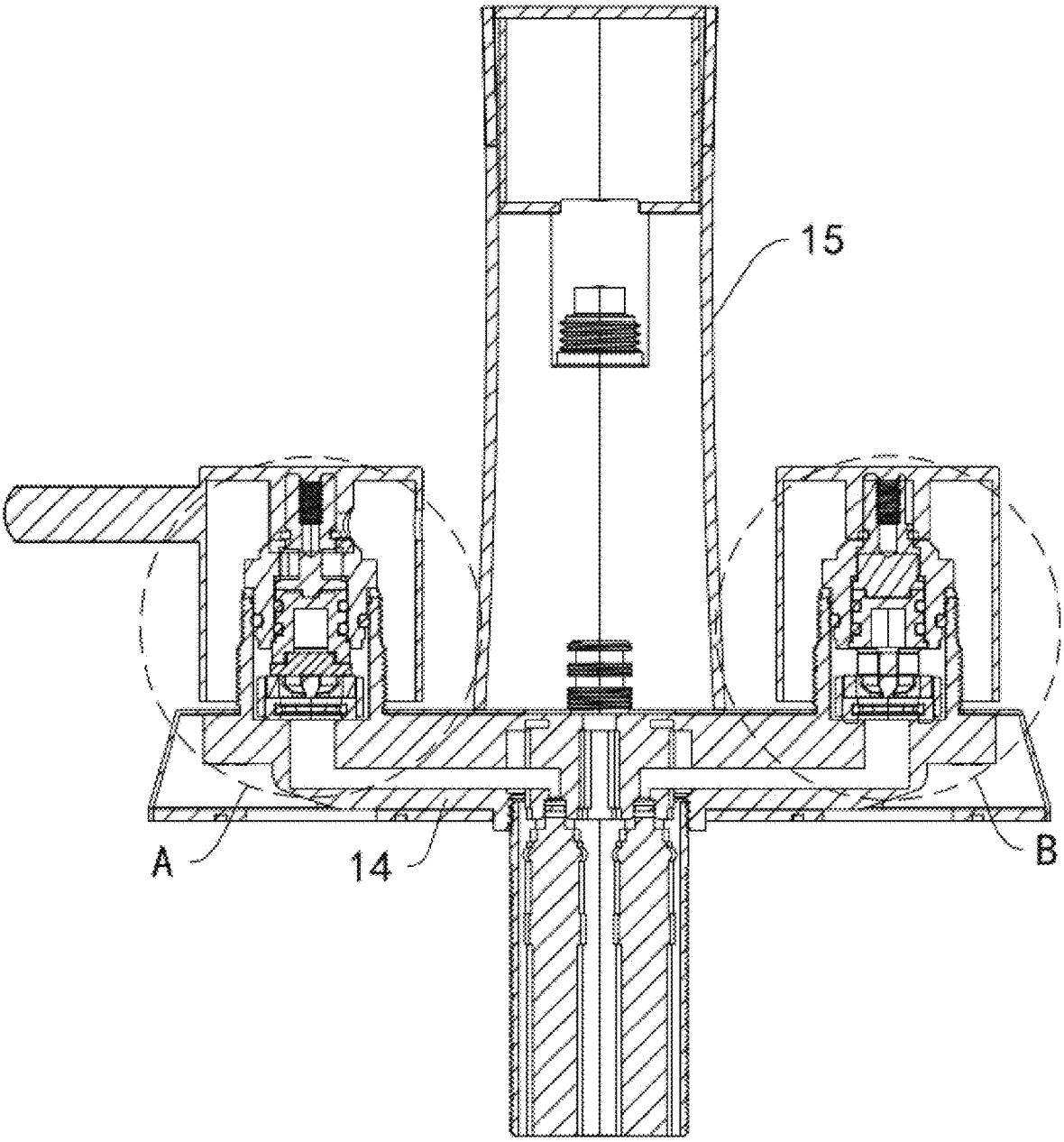
FIG. 6 is a sectional view of an adjustment component in an embodiment of the present application.
Figure 7:
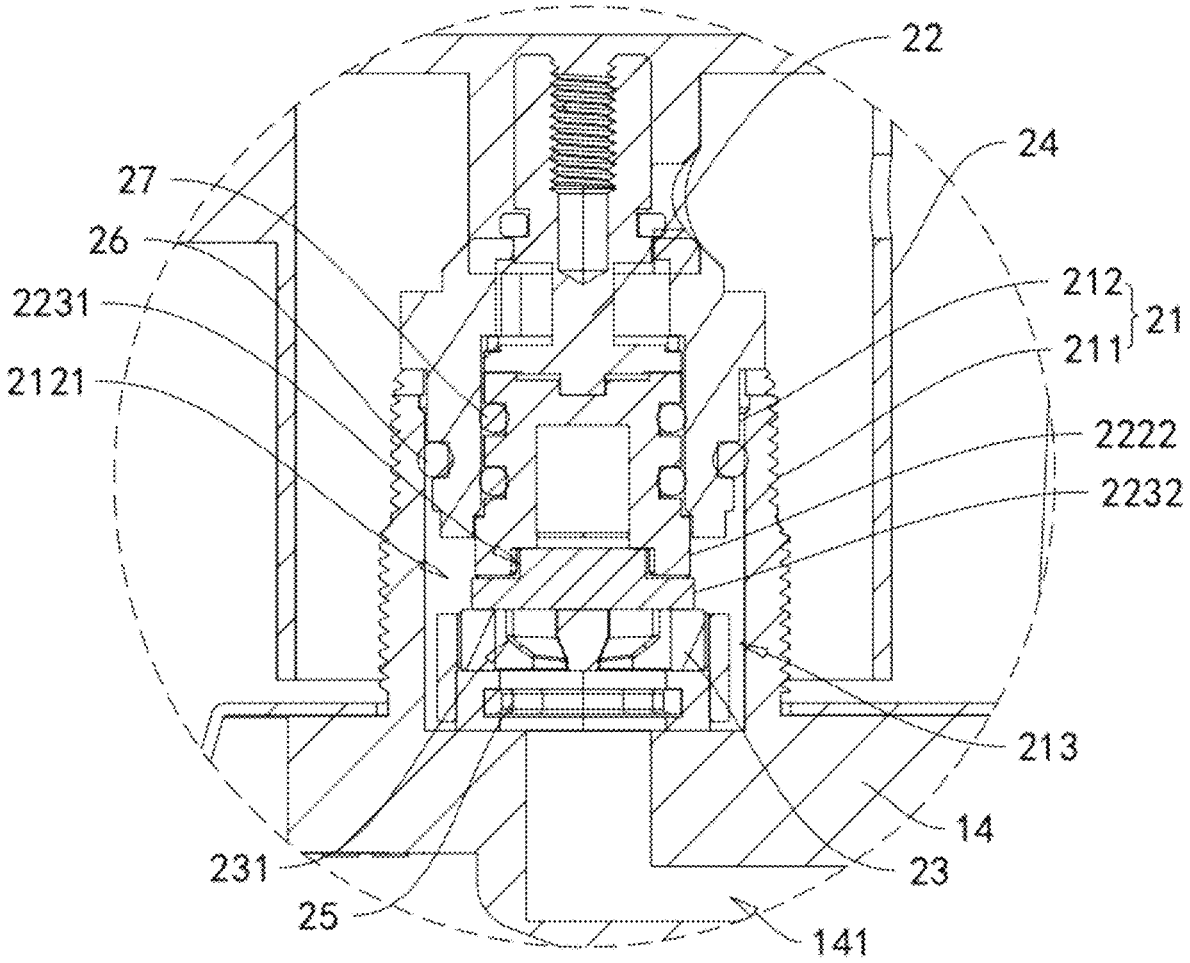
FIG. 7 is an enlarged view of part A of FIG. 6.
Figure 8:
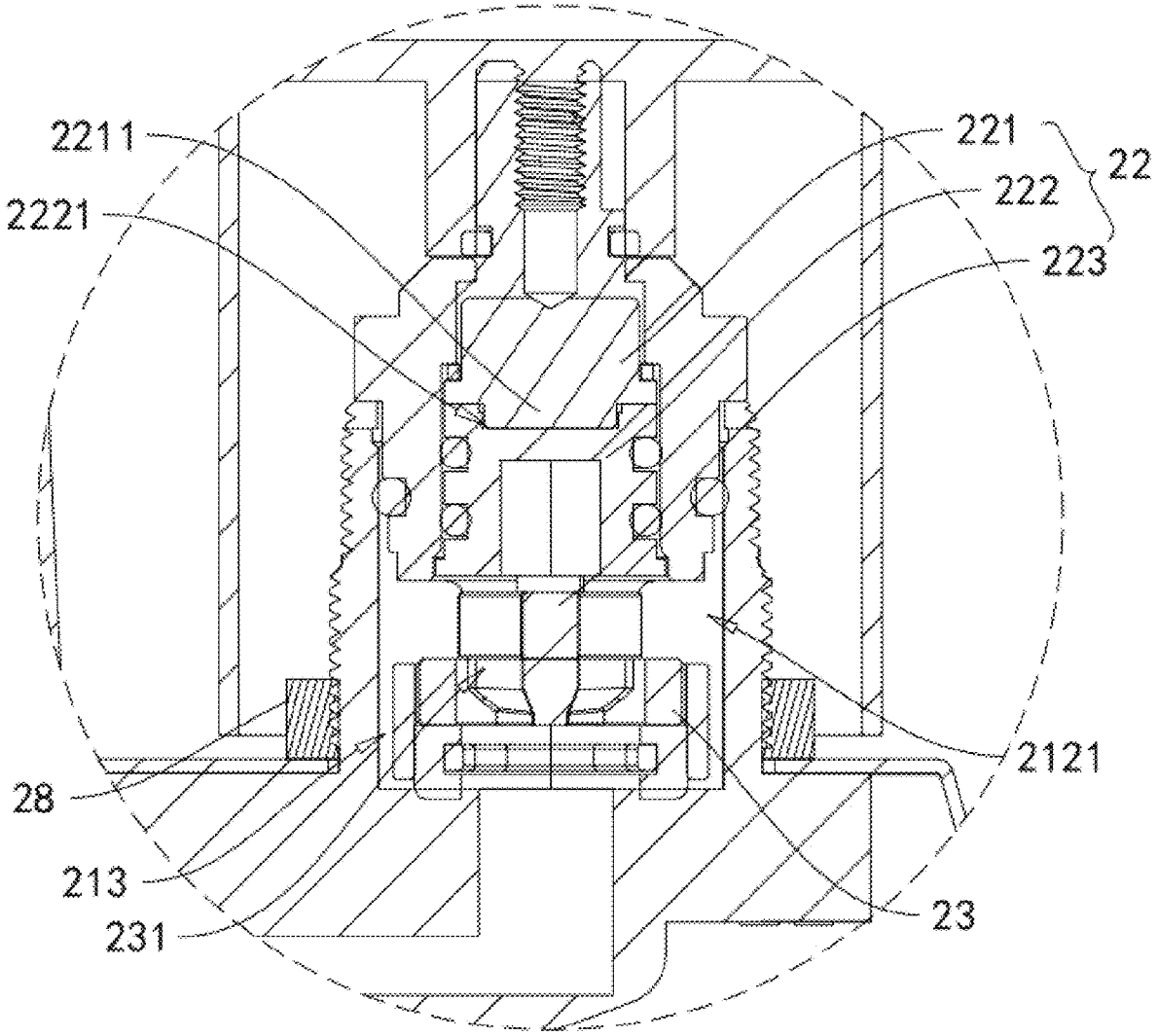
FIG. 8 is an enlarged view of part B of FIG. 6.

Referring to FIGS. 6, 7, and 8, the regulation components 2 include an adjustment seat 21, the adjustment seat 21 is fixedly provided on the water outlet main body 1. The adjustment seat 21 includes a seat body part 211 and a valve body part 212. The seat body part 211 is fixedly provided on the main body 14, and the seat body part 211 is hollow in the middle. The valve body part 212 passes through a middle position of the seat body part 211 and is fixedly connected to the seat body part 211. The valve body part 212 is hollow in the middle, and a gap between the seat body part 211 and the valve body part 212 forms a water outlet chamber 213. Two water outlet chambers 213 are respectively communicated to the two second inlet channels 142, so that one water outlet chamber 213 is communicated to the cold water outlet 12 and the other water outlet chamber 213 is communicated to the hot water outlet 13.

Referring to FIGS. 6, 7, and 8, the regulation components 2 further include an adjustment valve core 22. The adjustment valve core 22 passes through and is rotatably provided at a middle position of the valve body part 212. The adjustment valve core 22 includes a rotating part 221, a sealing part 222, and a valve core part 223. The rotating part 221 is rotatably provided at a top of the valve body part 212, and a rotation bump 2211 is fixedly provided at a bottom of the rotating part 221. The sealing part 222 is rotatably provided at a middle position of the valve body part 212, and a rotation recess 2221 is provided on one side of the sealing part 222 near the rotating part 221. The rotation bump 2211 passes through and is clamped with the rotation recess 2221. One side of the sealing protrusion 2222 away from the rotating part 221 is fixedly provided with a sealing protrusion 2222. The valve core part 223 is rotatably provided on the valve body part 212 and located at a bottom of the sealing part 222; a sealing recess 2231 is provided on one side of the valve core part 223 near the sealing part 222. The sealing protrusion 2222 passes through and is clamped into the sealing recess 2231. Thus, when the rotating part 221 is rotated, the rotating part 221 drives the sealing part 222 to rotate, and the sealing part 222 is rotated and drives the valve core part 223 to rotate.

Referring to FIGS. 6, 7, and 8, the regulation components 2 further include an adjustment valve body 23 and an adjustment handle 24. The adjustment valve body 23 is fixedly provided on the valve body part 212 and located at a bottom of the valve core part 223. The adjustment valve body 23 is provided with an adjustment port 231 that is penetrated, and the two adjustment ports 231 are respectively communicated to the two first inlet channels 141, so that one adjustment port 231 is communicated to the cold water pipe and the other adjustment port 231 is communicated to the hot water pipe. The valve body part 212 is provided with a water outlet groove 2121 that is penetrated, and the water outlet groove 2121 is communicated to the water outlet chamber 213. An adjustment block 2232 for sealing the adjustment port 231 is fixedly provided on one side of the valve core part 223 near the valve body part 212. When the adjustment port 231 is opened, the adjustment port 231 and the water outlet groove 2121 are communicated. A sealing degree of the adjustment port 231 is adjusted by adjusting the adjustment block 2232, and the adjustment handle 24 is rotatably provided on an outer peripheral surface of the seat body part 211, the adjustment handle 24 is clamp and fixed with the rotating part 221, so that when the adjustment handle 24 is rotated, the rotating part 221 is rotated accordingly.

Referring to FIGS. 6, 7, and 8, the regulation components 2 further include a first sealing ring 25, the first sealing ring 25 is fixedly provided on the valve body part 212. One end of the first sealing ring 25 abuts against the adjustment valve core body 23, and the other end of the first sealing ring 25 abuts against the main body 14, so that when water enters the valve body part 212, it is not easy for water to penetrate into the water outlet chamber 213 from a contact position between the valve body part 212 and the main body 14, thereby improving a regulation effect of the regulation component 2 on the water inlet volume.

Referring to FIGS. 6, 7, and 8, the regulation components 2 further include a second sealing ring 26, the sealing ring 26 is fixedly provided on an outer peripheral surface of the valve body part 212 and abuts against the seat body part 211, so that when water enters and exits from the water outlet chamber 213, it is not easy for it to seep out of the regulation components 2 from a connection position between the seat body part 211 and the valve body part 212, thereby improving the sealing performance of the regulation components 2 against water.

Referring to FIGS. 6, 7, and 8, the regulation components 2 further include two third sealing rings 27. The two third sealing rings 27 are fixedly provided at the sealing part 222 and abuts against the valve body part 212, so that when water enters and exits from the water outlet chamber 213, it is not easy for it to seep out of the regulation components 2 from a connection position between the adjustment valve core 22 and the valve body part 212, thereby improving the sealing performance of the regulation components 2 against water.

Referring to FIGS. 6, 7, and 8, the regulation components 2 further includes a fixing nut 28. The fixing nut 28 is threaded to an outer peripheral surface of the seat body part 211 and fixedly abuts against the water outlet part 15, thereby fixing the seat body part 211 to the water outlet main body 1.

Figure 9:
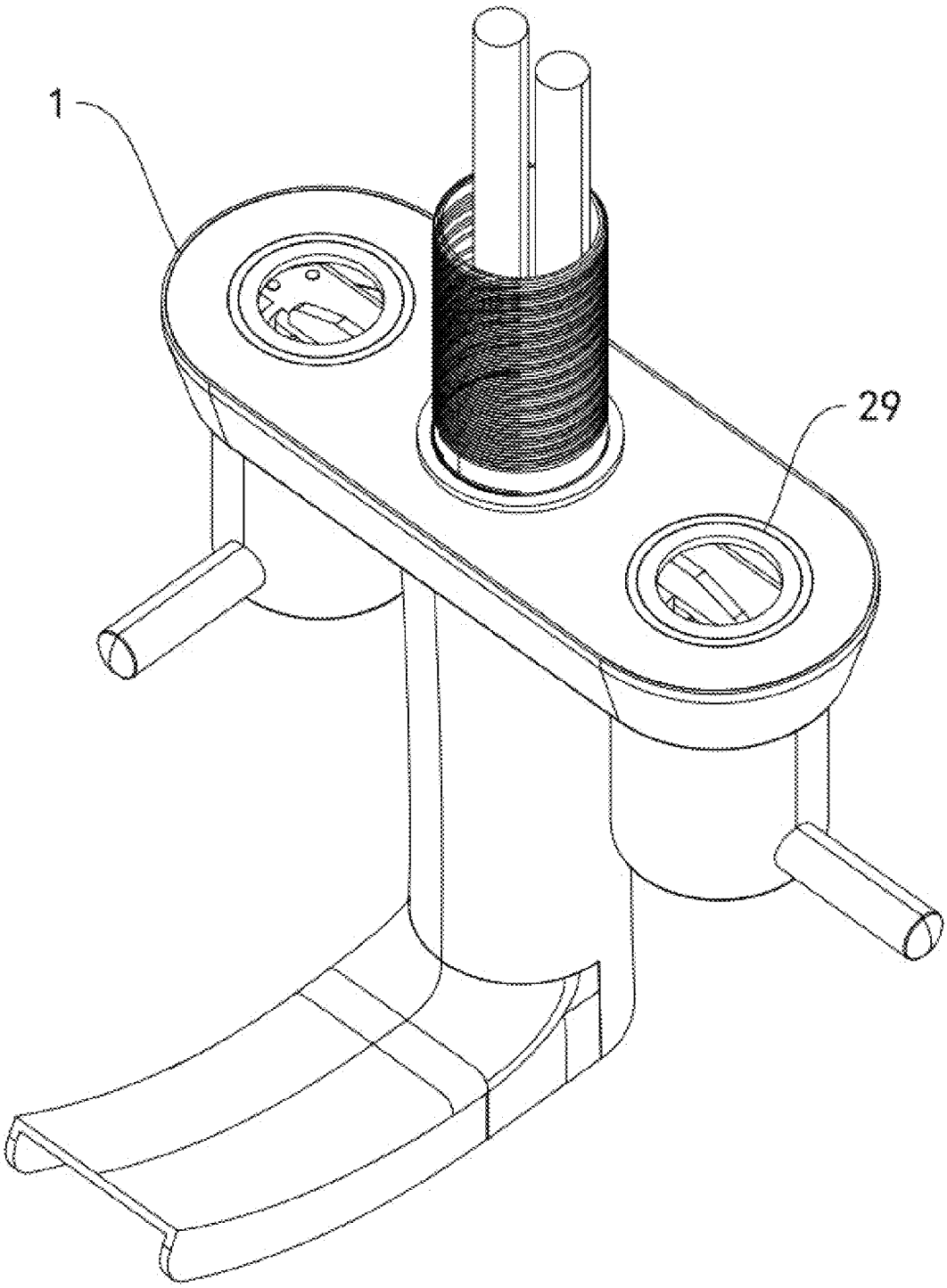
FIG. 9 is a schematic structural diagram of a waterproof ring in an embodiment of the present application.

Referring to FIG. 9, two waterproof rings 29 are fixedly provided at a bottom of the water outlet main body 1.

The implementation principle of the faucet device for regulating hot and cold water in the present application is as follows: when water outlet temperature of the faucet needs to be adjusted, water inlet volumes of the two sets of regulation components 2 are adjusted separately, thereby changing the water inlet volume of the cold water outlet 12 and the inlet water of the hot water outlet 13. As the water inlet volumes of the cold water outlet 12 and the hot water outlet 13 are changed, the water inlet ratio between the cold water and hot water are changed, resulting in a change in the water outlet temperature of the water outlet 11. When the water outlet temperature of the water outlet 11 is too high or too low, the water inlet volumes of the cold water or hot water are adjusted separately by two regulation components 2, thereby achieving the adjustment of the water outlet temperature of the water outlet 11 by separately changing the water inlet volume of the cold water or hot water. This renders it easier for a user to adjust the water outlet temperature of the faucet to a suitable use temperature, improves a problem of increasing the amount of cold water entering and reducing the amount of hot water entering when adjusting the water outlet temperature of the faucet, which results in a difficult change in the ratio of cold water and hot water entering when the valve core is rotated at the same unit angle and results in a difficult for the user to adjust the water outlet temperature of the faucet to the suitable use temperature.

The above are preferred embodiments of the present application and do not limit the protection scope of the present application. Therefore, any equivalent changes made according to the structure, shape, and principle of the present application should be included in the protection scope of the present application.

What is claimed is:

1. A faucet device for regulating hot and cold water, comprising a water outlet main body and two sets of regulation components;

the water outlet main body is provided with a water outlet, a cold water outlet, and a hot water outlet;

the cold water outlet is communicated to the water outlet, and the hot water outlet is communicated to the water outlet;

the two sets of regulation components are both provided on the water outlet main body and configured to regulate water inflow;

a water outlet end of one regulation component is communicated to the cold water outlet, and a water inlet end of the one regulation component is communicated to a cold water pipe;

a water outlet end of an another regulation component is communicated to the hot water outlet, and a water inlet end of the another regulation component is communicated to a hot water pipe;

wherein the water outlet main body comprises a main body and a water outlet part, the main body and the water outlet part are fixedly connected;

the main body is provided with two first inlet channels and two second inlet channels, one end of one first inlet channel is communicated to the cold water pipe and another end of the first inlet channel is communicated water inlet end of the one regulation component;

one end of an another first inlet channel is communicated to the hot water pipe and an another end of the another first inlet channel is communicated to the water inlet end of the another regulation component;

one end of one second inlet channel is communicated to the water outlet end of the one regulation component and an other end of the second inlet channel is communicated to the cold water outlet;

one end of an other second inlet channel is communicated to be water outlet end of the another regulation component and an other end of the other second inlet channel is communicated to the hot water outlet.

2. The faucet device for regulating hot and cold water according to claim 1, wherein the water outlet main body is provided with a water outlet channel, the water outlet channel is communicated to the water outlet, and the water outlet channel is curved in an are shape.

3. The faucet device for regulating hot and cold water according to claim 2, wherein the water outlet channel is fixedly provided with a filter screen.

4. The faucet device for regulating hot and cold water according to claim 1, wherein the regulation components comprise an adjustment seat, an adjustment valve core, an adjustment valve body, and an adjustment handle;

the adjustment seat is fixedly provided on the water outlet main body, the adjustment valve core is rotatably provided on the adjustment seat, the adjustment valve core is fixedly provided with an adjustment block, the adjustment valve body is fixedly provided on the adjustment seat;

the adjustment valve body is provided with an adjustment port, and adjustment port is communicated to the cold water pipe;

the adjustment handle is rotatably provided on the adjustment seat and is fixedly connected to the adjustment valve core;

when the adjustment valve core is rotated, the adjustment port is closed.

5. The faucet device for regulating hot and cold water according to claim 4, wherein the regulation components further comprise a fixing nut, the fixing nut is threaded to an outer peripheral surface of the adjustment seat and abuts against the water outlet main body.

6. The faucet device for regulating hot and cold water according to claim 1, wherein the adjustment seat comprises a seat body part and a valve body part;

the seat body part and the valve body part are fixedly connected; and a water outlet chamber is formed between the seat body part and the valve body part, the water outlet chamber is communicated to the cold water outlet, the adjustment valve body is fixedly provided on the valve body part, and the valve body part is provided with a water outlet groove;

the water outlet groove is communicated to the water outlet chamber;

when the adjustment port is opened, the adjustment port is communicated to the water outlet groove;

wherein the regulation components further comprise a first sealing ring that is fixedly provided on the valve body part, one end of the first sealing ring abuts against the adjustment valve body, and the other end of the first sealing ring abuts against the water outlet main body.

7. The faucet device for regulating hot and cold water according to claim 6, wherein the regulation components further comprise a second sealing ring;

the second sealing ring is fixedly provided on an outer peripheral surface of the valve body part and abuts against the seat body part.

8. The faucet device for regulating hot and cold water according to claim 6, wherein the regulation components further comprise a plurality of third sealing rings, each of which is fixedly provided on the adjustment valve core and abuts against the valve body part.

9. The faucet device for regulating hot and cold water according to claim 1, wherein two waterproof rings are fixedly provided at a bottom of the water outlet main body.

* * * * *